United States Patent [19]

Ogawa et al.

[11] 4,302,132

[45] Nov. 24, 1981

[54] METHOD OF INJECTING GROUT INTO SOIL

[75] Inventors: Taihei Ogawa, Musashino; Seizo Kubota, Murayama; Mineo Murata, Tokyo; Shigeru Sekita, Yamato, all of Japan

[73] Assignees: Sato Kogyo Kabushiki Kaisha, Toyama; Yamaguchi Kikai Kogyo Kabushiki Kaisha, Tokyo, both of Japan

[21] Appl. No.: 70,291

[22] Filed: Aug. 28, 1979

[30] Foreign Application Priority Data

Aug. 30, 1978 [JP] Japan ..... 53-105914

[51] Int. Cl.[3] ..... E02D 3/12

[52] U.S. Cl. ..... 405/269; 405/266

[58] Field of Search ..... 405/269, 263, 235, 236, 405/240, 241, 242, 248, 266, 267, 268, 233; 141/311 R, 392; 166/291

[56] References Cited

U.S. PATENT DOCUMENTS

| | | | |
|---|---|---|---|
| 2,960,831 | 11/1960 | Lonaberger et al. | 405/263 |
| 3,518,834 | 7/1970 | Gnaedinger et al. | 405/269 |
| 3,530,675 | 9/1970 | Turzillo | 405/266 X |
| 3,949,561 | 4/1976 | Chapman | 405/266 |
| 3,986,536 | 10/1976 | Janson | 405/269 X |

FOREIGN PATENT DOCUMENTS

| | | | |
|---|---|---|---|
| 1403857 | 5/1965 | France | 405/269 |
| 1016350 | 1/1966 | United Kingdom | 405/240 |

*Primary Examiner*—Dennis L. Taylor

*Attorney, Agent, or Firm*—Blanchard, Flynn, Thiel, Boutell & Tanis

[57] ABSTRACT

A method of injecting grout into soil using a combined injection and boring rod wherein the rod comprises a tip and at least one injection nozzle at the lowermost end thereof. A sleeve packer of an elastomeric material is embedded in a recess in the periphery of the rod along the length thereof. A plurality of passages extend in and along the rod, the passages being defined by at least two parallel inner tubes spaced within an outer tube, and further by the spacing between the outer tube and the inner tubes. The method includes the steps of inflating the sleeve packer by introducing fluid pressure into the recess through a hole in the outer tube communicating with one of the passages, feeding two liquids of curable grout through respective passages and mixing the two liquids within the rod at the tip of the rod, and then injecting the mixed grout into the soil from the injecting nozzle. Prior to inflating the sleeve packer, the rod is actuable for boring a hole in the soil to a predetermined depth using the boring tip on the rod. After the step of injecting the mixed grout, the packer is retracted into the recess and the rod can then be actuated to restart boring to a greater depth.

8 Claims, 9 Drawing Figures

METHOD OF INJECTING GROUT INTO SOIL

BACKGROUND OF THE INVENTION

The present invention relates to a method of injection of grout into soil comprising the steps of boring soil and injecting the grout, and repeating the above steps using a boring and grout injection rod having a packer at the lower portion thereof in which a grout injection tube may be used as a boring rod.

Various grout injection methods heretofore have been proposed. One of the most considerable difficulties has been in rotation and axial movement of boring rod. When instantaneously curable grout, the gellation time of which is several seconds to several minutes is used, a firmly solidified mass is formed around the injection tube. Accordingly, the injection rod is firmly anchored by the solidified mass therearound, occasionally resulting in difficulty of rotation and extraction of the rod. Although this difficulty may be solved by the use of a grout having a longer gellation time (several minutes to several ten of minutes), a solidified soil mass which is in cylindrical form with respect to the axis of rod can not be obtained. In particular, this is remarkable in complicated formation of soil. In order to position the injection tube in place, it is necessary to prevent the curvature of bore hole. It is occasionally impossible to avoid the curvature of bore hole since the injection tube generally bends under the influence of biasing force from the soil.

Various methods are adopted such as sealing, with hardened grout, an interstice between the bore wall and an injection tube or inflating a packer attached to the injection tube by feeding compressed air through a pipe during the injection to prevent the leakage of the grout to the ground surface. However, the former sealing method with a grout generally involves leakage of much grout or "jamming" due to high resistance of the grout seal. The latter method using a packer is not desirable when the bore hole wall is rough or working is accomplished at much greater depth. A new injection tube having a packer attached thereto should be inserted into bore hole after the boring has been completed. Such work requires alternative steps of boring and grouting which is time-consuming. There has been proposed a method of inserting a casing pipe into an injection area and then inflating the packer attached to an injection tube within the casing pipe when the bore wall is rough. However, the cost of a casing pipe and the work in its insertion is so high that such cost can not be neglected.

BRIEF SUMMARY OF THE INVENTION

It is an object of the present invention to provide a method of the economical and positive injection of grout.

It is another object of the invention to provide a method of using a packer which is inflated when a fluidic pressure is applied thereupon and which is retracted when the pressure is removed.

It is a further object of the invention to provide a method of injection of grout in which the leakage of the grout to the ground surface is prevented by the inflated packer and in which boring can be readily started again.

It is still further object of the invention to provide a method of steady and economical soil treatment using a single combined boring and injection rod in which a boring rod is also used for a grout injection tube.

It is still further object of the invention to provide a method of successive soil treatment by repeating boring and grout injection steps in which the effect of the following grout injection may be made enough by acting the packer upon the wall of bore hole of the grout treated soil.

It is still further object to provide a method of soil treatment at greater depth in which curvature of bore hole and "jamming" may be prevented however fragile soil may be.

It is still further object to provide a method of injection of grout having a short gellation time into a restricted area of soil in which the injection rod is not restrained by the hardened grout.

Other objects and advantages of the invention will become apparent during the following discussion of the accompanying drawings in which.

FIG. 3 (*a*)–(*g*) are schematic views sequentially showing steps of a method of the present invention.

Figure 1:
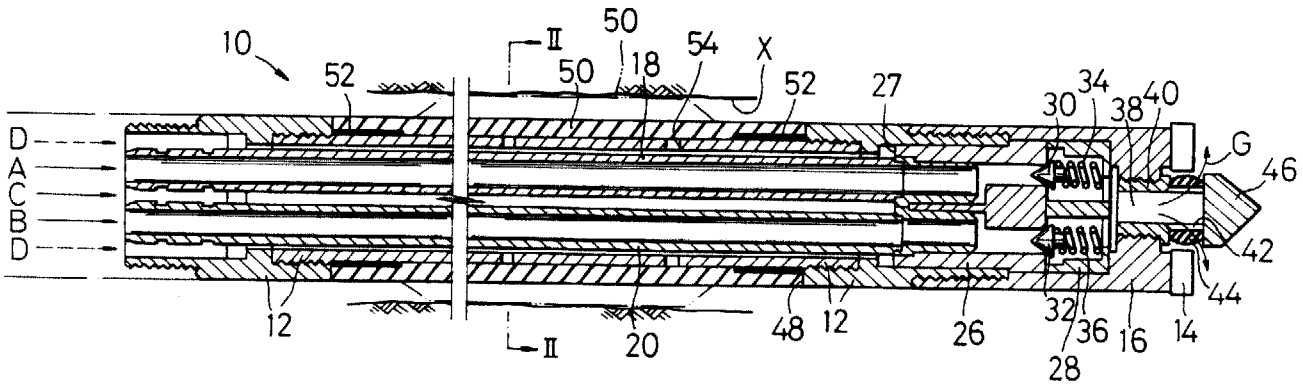
FIG. 1 is a cross-sectional view showing a boring and grout injection rod of the present invention.
Figure 2:
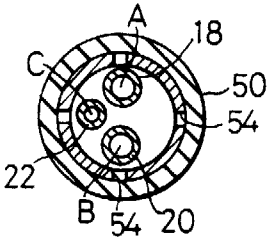
FIG. 2 is a cross-sectional view along the line II—II of the FIG. 1.
Figure 3A:
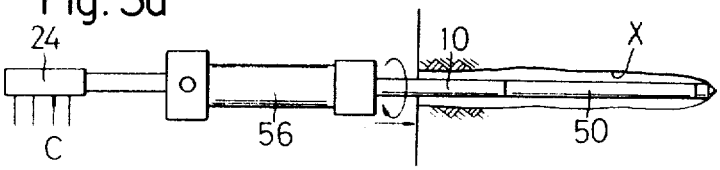
Figure 3B:
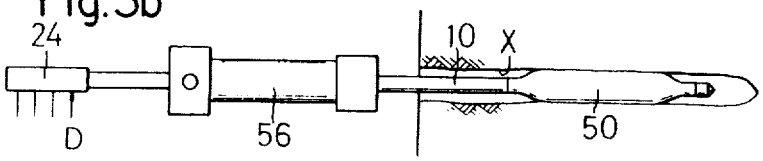
Figure 3C:
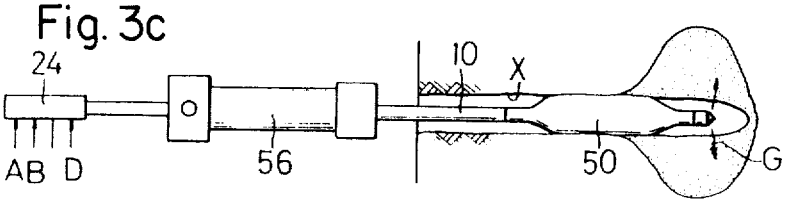
Figure 3D:
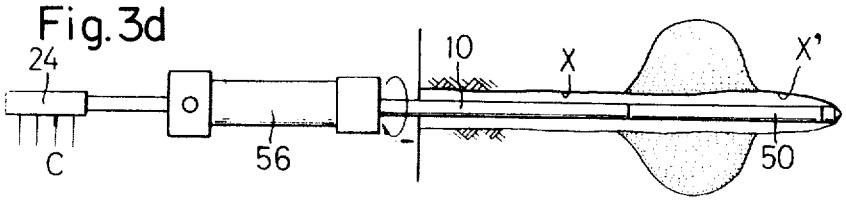
Figure 3E:
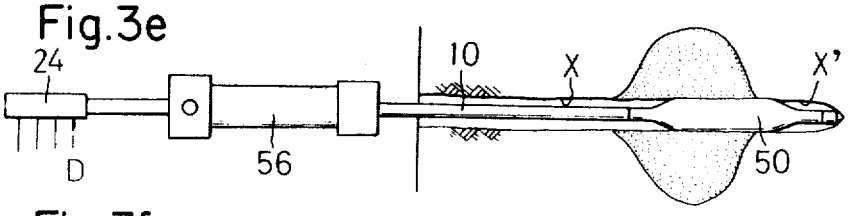
Figure 3F:
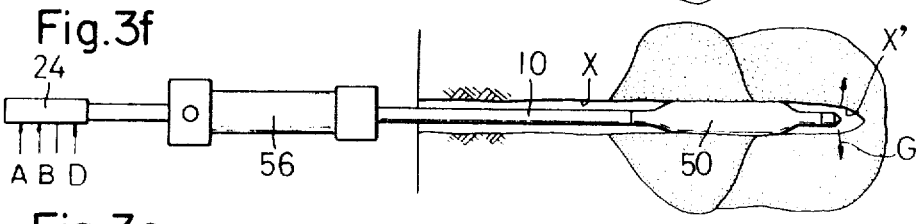
Figure 3G:
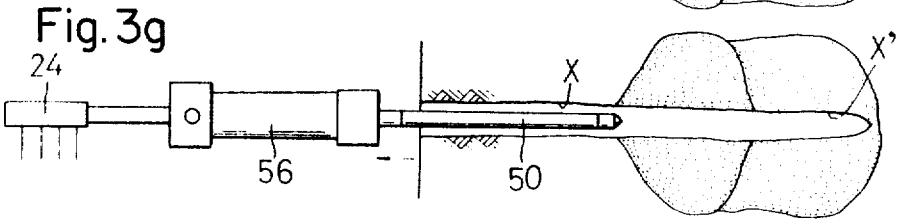

Referring now to FIGS. 1 and 2, there is shown a lowermost portion 10 of combined injection and boring rod which is used for the method of the present invention. The lowermost portion 10 includes an outer tube 12 to which a cemented carbide bit 16 is connected at the end thereof. The cemented carbide bit 16 is provided with a tip 14 at the lowermost end. The outer tube 12 surrounds three inner tubes 18, 20 and 22 which are disposed in parallel relationship with each other. The inner tubes 18, 20 and 22 extend from a swivel 24 which is shown in FIG. 3 to the vicinity of the end of the outer tube 12. The inner tubes 18, 20 and 22 define passages A, B and C respectively and define a passage D with the outer tube 12. A guide 26 and valve chamber 28 are disposed at the inside of the cemented carbide bit 16. Control valves 30 and 32 (a valve for the passage C is not shown) are provided for preventing counterflow and controlling the flow rate. The valves (as at 34 and 36) are biased by springs 34 and 36 so that they normally close the passages A, B and C. A ring 40 which defines a mixing chamber 38 is threadably engaged with the cemented carbide bit 16. The mixing chamber 38 communicates with passages A, B and C. The ring 40 is formed with injection nozzles 42 on the periphery thereof. A flexible sleeve valve 44 of rubber and the like overlies the injection nozzles 42. The ring 40 is provided at the lowermost end thereof with a frusto conical tip which is a cutting blade. Thus, the liquids which are pumped through passages A, B and C press the respective control valves (as at 30 and 32) downward against the biasing forces of the respective springs (as at 34 and 36). They enter the mixing chamber 38 in which they are instantly mixed with each other. The mixed liquids then expand the sleeve valve 44 in a radial direction with respect to the axis of tube and are discharged in a horizontal direction with respect to the ground surface. Alternatively a single liquid may be used in lieu of a plurality of kinds of liquids.

The outer tube 12 is formed with a recess portion on the periphery thereof along the length (for example 150 cm) thereof. A sleeve packer 50 which is formed of a hard rubber is embedded in the recess portion 48 so that the packer 50 is flush with tube 12. The packer 50 is bonded with the outer tube 12 at opposite ends thereof. The length of bonded portions 52 is in the order of 30 cm. The outer tube 12 is formed with four through-holes 54 in the vicinity of the mid-point of the recess portion 48. The aforementioned passage D extends beyond the recess portion 48 while it does not reach at the tip-end of the tube. The passage D terminates at the end of the guide 26. Thus, when air or water is pumped through the passage D under pressure, the pressure is applied upon the inner side of the packer 50 through the holes 54 so that the sleeve packer 50 inflates as shown in phantom line of FIG. 1. When the fluid pressure is removed, the packer 50 retracts into the recess portion 49 due to the recovery properties thereof.

The method of the injection of grout into soil using the combined injection and boring rod 10 is sequentially shown in FIG. 3. Reference numeral 56 represents a positioner for positioning the injection and boring rod 10 in place. The rod 10 is advanced into the soil while it is rotated. The boring is continued until the rod reaches at the desired depth as shown in FIG. 1(*a*).

During this boring, a lubricant such as water, or a mixture of water and bentonite and air is alternatively fed through the passage C. As the result, slime is discharged to the ground surface through a spacing between bore hole x and the rod 10. Water is then fed through the passage D under pressure to inflate the sleeve packer 50 so that the packer is pressed upon the wall of bore hole x. Liquids A and B which will form two-liquid curable grout G are fed under pressure through passages A and B respectively. The liquids are mixed with each other in the mixing chamber 38. The mixed curable grout G is injected into surrounding soil to be treated. It is preferable that the gellation time of grout G be not longer than 60 seconds. In this time, the injected grout can not leak to the ground surface since it is blocked by inflated packer 50. After the completion of the injection, the packer 50 is retracted by stopping the supply of water into the passage D. With the packer in retracted condition, the rod 10 is rotated to advance so that bore hole is bored to a next depth. Simultaneously, slime is forced to be discharged. The forming of slime may be smoothly accomplished since the bore hole x has been formed in advance. The working which is similar to that shown in FIGS. 3(*b*) and (*c*) is accomplished as shown in FIGS. 3(*e*) and (*f*). The packer 50 which is in inflated condition positively works on the wall of solidified soil mass since the wall of bore hole is firm and smooth. After all of boring and grouting have been finally accomplished, the rod 10 is extracted as shown in FIG. 3(*g*). According to the method of the present invention, a plurality of grout treated soil masses may be successively formed either for the purpose of increasing the bearing strength of the soil or to provide an anchoring mass for a pipe.

While the described embodiment represents the preferred form of the present invention, it is to be understood that modifications will occur to those skilled in that art without departing from the spirit of the invention. The scope of the invention is therefore to be determined solely by the appended claims.

What is claimed is:

1. A method of injecting grout into soil using a combined injection and boring rod wherein said rod comprises a boring tip and at least one injection nozzle at the lowermost end thereof; a sleeve packer of an elastomeric material which is embedded in a recess in the periphery of said rod along the length thereof; and a plurality of passages extended in and along said rod, said passages being defined by more than one of parallel inner tubes in an outer tube and by the spacing between the outer tube and the inner tubes; said method comprising the steps of inflating said sleeve packer by introducing fluid pressure into said recess through a hole in said outer tube, which hole communicates with one of said passages; feeding two liquids of curable grout through respective passages; mixing said two liquids within said rod at said boring tip of said rod; and injecting the mixed grout into the soil from said injecting nozzle.

2. The method of injecting grout into soil defined in claim 1 in which said sleeve packer is bonded with the recess of said rod at the opposite ends thereof and said hole is formed between said bonded opposite ends.

3. The method of injecting grout into soil defined in claim 1 in which said passage communicating with said packer is the spacing between the inner tubes and the outer tube which forms said rod.

4. The method of injecting grout into soil defined in claim 1 in which the gellation time of the grout after mxing is not greater than 60 seconds.

5. The method of claim 1 including:

prior to said inflating of said sleeve packer, the step of boring a hole in soil to a predetermined depth using the boring tip of said rod, stopping boring, and with said rod still in place in its bored hole thereafter carrying out said step of inflating said sleeve packer on said rod;

after the step of injecting the mixed grout, carrying out the further steps of retracting said packer into said recess by removing said fluid pressure from said recess, restarting said boring to a greater depth by means of said rod, and repeating the aforesaid steps.

6. The method of claim 1 in which the step of feeding two liquid employs liquids which do not cure to hardened condition unless mixed but which do cure to a hardened condition soon after being mixed, the step of feeding two liquids including feeding of said two liquids from their respective passages through respective one-way valves to a mixing chamber located within said rod at said boring tip, said step of mixing being carried out in said mixing chamber;

after completing said step of injecting, then retracting said sleeve packer, and carrying out the further steps in an approximately simultaneous manner of boring the soil to a greater depth by means of said boring tip on said rod, and feeding a lubricant fluid through a fourth one of said passages and through a further one-way valve and thence through said mixing chamber and out of said rod through said injecting nozzle.

7. The method of claim 6 in which said steps of feeding two liquids of curable grout and feeding lubricant fluid are carried out through respective first, second and third ones of said parallel inner tubes, and said step of inflating said sleeve packer is carried out by feeding of said fluid pressure through the one of said passages defined by the spacing between the outer tube and the inner tubes, such that said fluid pressure is maintained separated from the contents of said inner tubes and mixing chamber.

8. A combined injection and boring rod for injecting grout into soil for the purpose of solidifying same or for the purpose of forming a wall, including an elastic sleeve packer embedded in a recess on the periphery of said combined injection and boring rod and extending along the length thereof, said packer enclosing the rod and being inflatable by fluid pressure applied via through-holes provided within said recess, and being retractable to its uninflated condition when said fluid pressure is removed, and passages within said combined injection and boring rod which are adapted to supply the grout to an injection nozzle at the lower end of said combined injection and boring rod, wherein the improvement comprises a plurality of said passages extending within and along said combined injection and boring rod, said passages being formed by a plurality of parallel inner tubes within an outer tube and by spaces between said outer tube and said inner tubes;

a mixing chamber, the majority of said passages being formed by the inner tubes, ones of which are disposed for separately feeding two liquid components of the grout to said mixing chamber prior to injection, said liquid components being of the type which are cured with one another after mixing and injection, said mixing chamber being located at the outlet of said passages adjacent said injection nozzle so that a liquid component mixture can be injected as grout from said mixing chamber through said injection nozzle into the soil;

said passage formed by the spaces between said outer tube and said inner tubes communicating with said through-holes for exerting the fluid pressure on said sleeve packer;

whereby said combined injection and boring rod permits in sequence inflating said sleeve packer to exert pressure on the wall of a bore hole, injecting the grout into the surrounding soil, retracting said sleeve packer, starting boring to a greater depth by means of said combined injection and boring rod, and repeating these steps.

* * * * *